United States Patent [19]

Wynn

[11] 3,982,120

[45] Sept. 21, 1976

[54] FLASHLIGHT

[76] Inventor: Richard R. Wynn, 1891 Cleveland Ave., Abington, Pa. 19001

[22] Filed: Apr. 7, 1975

[21] Appl. No.: 564,781

Related U.S. Application Data

[63] Continuation-in-part of Ser. No. 480,038, June 17, 1974.

[52] U.S. Cl. ..... 240/10.6 R; 240/10.6 SD; 240/10.63; 240/10.66; 200/60; 340/252 R

[51] Int. Cl.[2] ..... F21L 7/00; F21L 9/00

[58] Field of Search ..... 240/10.6 R, 10.6 SD, 240/10.61, 10.63, 10.65, 10.66, 10.67, 10.68; 340/249, 251, 252 R; 200/60, 16 R

[56] References Cited

UNITED STATES PATENTS

| | | | |
|---|---|---|---|
| 2,566,280 | 8/1951 | Yandt | 200/60 |
| 3,113,197 | 12/1963 | Green | 340/252 R |
| 3,535,506 | 10/1970 | Moore et al. | 240/10.66 |
| 3,749,905 | 7/1973 | Friedman et al. | 240/10.66 |
| 3,825,740 | 7/1974 | Friedman et al. | 240/10.66 |
| 3,832,629 | 8/1974 | Cernek, Jr. | 340/249 |

*Primary Examiner*—Russell E. Adams, Jr.
*Attorney, Agent, or Firm*—Stanley B. Kita

[57] ABSTRACT

A lantern having a self-contained power supply and a primary source of illumination is provided with a secondary source of illumination which emits a small amount of light for enabling the lantern to be located readily in the dark.

13 Claims, 6 Drawing Figures

FLASHLIGHT

This application is a continuation-in-part of my copending application Ser. No. 480,038, filed June 17, 1974 for Lantern Having Locator Beacon and Operational Status Indicator.

The present invention relates to electric lanterns, and more particularly, the present invention relates to flashlights having means to enable the same to be readily located in the dark.

Various types of emergency lanterns are known in the art. The conventional lantern comprises a casing containing a power supply and a lamp connected to the supply through a switch. A species of this type of lantern is a flashlight.

Although known lanterns function satisfactorily, they have certain limitations. For instance, when the lantern is off, it is difficult to locate in the dark, such as in the event of a sudden electrical power failure and/or while engaged in outdoor activities where artificial illumination is not normally available. Because of this difficulty, known lanterns have not been as satisfactory as desired.

With the foregoing in mind, it is a primary object of the present invention to provide a novel lantern having a secondary light source which can be energized when the lantern is off to permit the lantern to be located readily in the dark.

It is another object of the present invention to provide a flashlight having a secondary light source such as a light-emitting diode capable of providing a secondary source of light for enabling the flashlight to be located readily in the dark.

As a further object, the present invention provides an improved lantern having a secondary light source which, in addition to providing a locator beacon for the lantern, cooperates with a voltage-responsive circuit to provide a readily visible indication of the status of the lantern power supply.

Yet another object of the present invention is to provide for use in combination with a flashlight, a simple light-emitting diode and switch assembly which mounts to the flashlight casing in an expeditious manner and with a minimum of parts.

As still another object, the present invention provides a flashlight having a unique switching assembly which cooperates with a light-emitting diode circuit to afford selective energization of the light-emitting diode in the circuit.

More specifically, in the present invention, a flashlight having a casing adapted to contain a series of batteries and bulb providing a primary source of illumination connected to the batteries through a switch is provided with a secondary source of illumination which emits a small amount of light for permitting the flashlight to be located in the dark. In one embodiment, the secondary light source includes a light-emitting diode which is electrically connected in parallel with the switch to emit light when the switch is off, the light-emitting diode protruding through an aperture in the casing from a base located on the inside of the casing and secured thereto. In another embodiment, the flashlight has a novel switch assembly which enables the light-emitting diode to be switched off when desired. In both embodiments, a voltage-responsive solid state device and/or a current-limiting device is carried by the base and connected to the light-emitting diode to cause the diode to emit light only as long as the voltage of the batteries is above a predetermined level and the primary source of illumination is operational.

These and other objects, features and advantages of the present invention should become apparent from the following description when taken in conjunction with the accompanying drawing in which.

Figure 1:
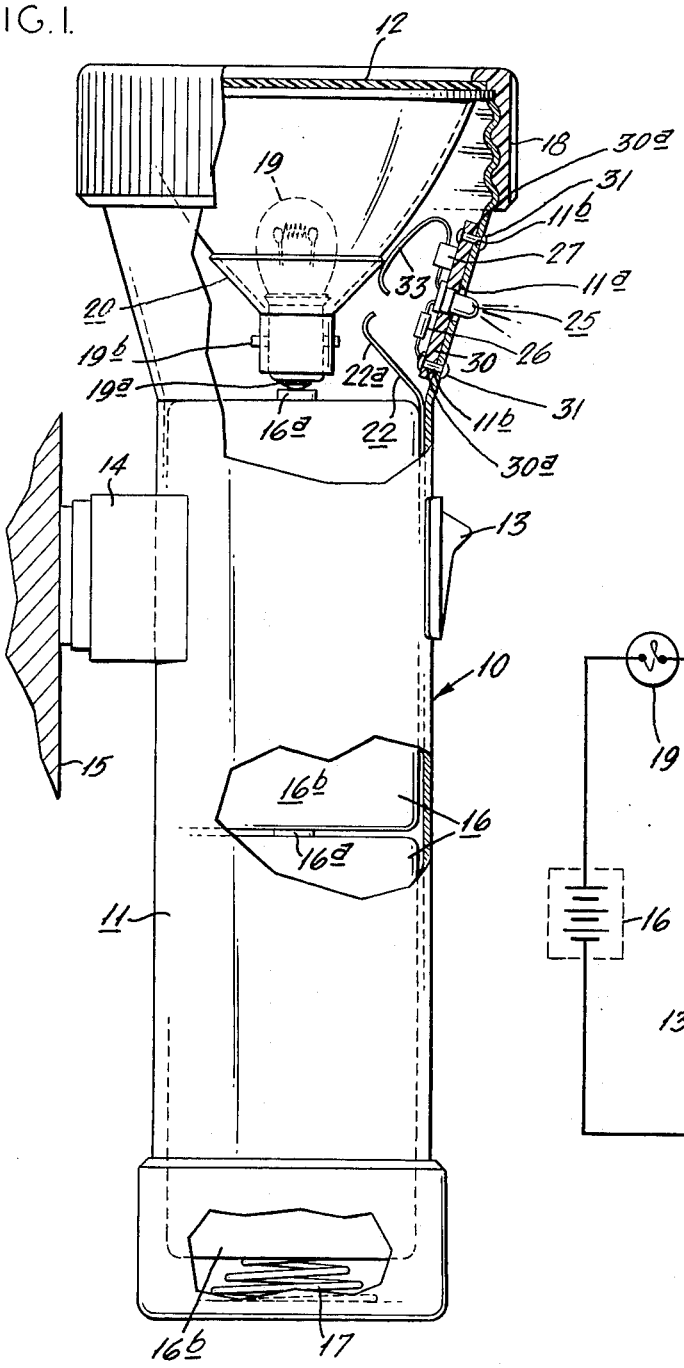
FIG. 1 is a side elevational view with portions broken away of an electric lantern embodying the present invention.

Referring now to the drawing, there is illustrated in FIG. 1 an electric lantern or flashlight 10 embodying the present invention. As best seen therein, the flashlight 10 has a hollow cylindrical casing 11 which mounts at its upper end a removable primary source of illumination, indicated generally at 12, for projecting a beam of light. A switch 13 is provided to energize the primary source of illumination 12, and means 14 is carried by the casing 11 for removably securing the flashlight 10 to an upright support 15. In the illustrated embodiment, the support 15 is metal, and the releasable fastening means 14 includes a magnet.

The casing 11 is adapted to contain a series of batteries, such as the batteries 16, 16. The battery 16 has a positive terminal **16*a* at its upper end and a negative terminal 16*b* at its lower end. In the illustrated embodiment, the casing 11 is metallic, and the negative terminal 16*b* of the lower battery is connected to the casing by means of a compression spring 17. The primary source of illumination 12 includes a screw cap and reflector assembly 18 which removably mounts an incandescent bulb 19 having a base 19*a* adapted to contact the positive terminal 16*a* of the battery 16. A collector ring 20 surrounds the lamp 19 and is spaced from the inside of the casing 11. The collector 20 is electrically conductive and is connected to a flange 19*b* of the bulb 19**.

The slide switch 13 engages an elongated conductor 22 mounted on the inside of the casing 11. The switch 13 operates to displace the upper end **22*a* of the conductor 22 into engagement with the ring 20 when the switch 13 is displaced upwardly into the on position. When so displaced, a primary circuit is completed between the batteries 16, the casing 11, and the bulb 19 in a well-known manner. Of course, displacement of the switch 13** downwardly opens the circuit and renders the primary source of illumination deenergized.

As described thus far, the flashlight 10 is conventional. As noted above, one of the primary disadvantages of the conventional flashlight resides in its inability to be located readily in the dark. Since it is often imperative for the flashlight to be located quickly in an emergency situation, it should be apparent that a flashlight having means whereby it may be readily located is highly desirable.

In accordance with the present invention, the flashlight 10 is provided with a secondary source of illumination which is connected to the batteries 16, 16 to emit a small amount of light to provide a beacon for permitting the flashlight to be located in the dark. In the illustrated embodiment, the secondary source of illumination is preferably provided by a light-emitting diode 25 which is carried by the casing 11 at its upper end adjacent the primary source of illumination 12. As best seen in FIG. 1, the light-emitting diode 25 is located adjacent the switch 13, and both the light-emitting diode 25 and the switch 13 are located diametrically opposite the magnet 14. Thus, when the flashlight 10 is secured to the support 15, the light emitted by the diode 25 is visible from the front of the support 15 and to some extent laterally thereof. Moreover, the light-emitting diode also indicates the location of the switch 13.

Figure 2:
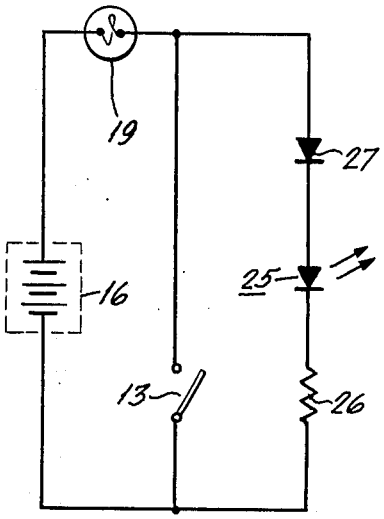
FIG. 2 is a schematic diagram of a preferred circuit employed in the lantern of the present invention.

As best seen in FIG. 2, the switch 13 is connected in series with the lamp 19, and the light-emitting diode 25 is preferably connected in parallel with the switch 13, although not necessarily. Both the switch 13 and the light-emitting diode 25 are preferably connected in series with the bulb 19, although not necessarily. A current-limiting resistor 26 is connected in series with the light-emitting diode 25, and a voltage-responsive device, in the present instance a forward-biased diode 27, is connected in series with the light-emitting diode 25 and the resistor 26, the anode of the diode 27 being connected to the positive terminal of the battery 16. The diode 27 conducts favorably above a predetermined threshold voltage (approx. 2.3 volts D.C.) but increases its impedence greatly as the voltage falls below the predetermined threshold voltage. Thus, as long as the voltage of the batteries 16, 16 is about 2.3 volts, the diode 27 conducts favorably and causes the light-emitting diode 25 to emit light.

The intensity of the light emitted by the diode 25 is dependent to some extent on the magnitude of the current flowing therethrough and this is controlled by the value of the current-limiting resistor 26. Preferably, the value of the resistor 26 is chosen to limit the current flow through the diode 25 to a value which optimizes the life of the batteries 16, 16. In practice, it has been found that a current of less than about 20 milliamperes causes the light-emitting diode 25 to emit sufficient light as to enable the flashlight 10 to be located in the dark while ensuring an adequate operational life for the batteries 16, 16. Since the current drawn by a conventional flashlight lamp may be a few amperes in magnitude, it should be apparent that the intensity of the illumination provided by the light-emitting diode 25 is substantially less than the intensity of illumination provided by the flashlight lamp 19.

The light-emitting diode 25 is mounted in the flashlight 10 in a novel manner. To this end, the light-emitting diode 25 is secured to a base 30 which engages the inside of the casing 11, and the diode 27 and resistor 26 are mounted to the base 30. As best seen in FIG. 1, the casing 11 has an aperture 11*a* for receiving the light-emitting diode 25, and the casing 11 has a pair of spaced mounting holds 11*b*, 11*b* which register with a like pair of holes 30*a*, 30*a* in the base 30 for receiving fasteners 31, 31. In the present instance, the resistor 26 is mounted on the base 30 and is connected at one end to the lower one of the fasteners 31 to provide electrical contact with the casing. The other end of the resistor 26 is connected to the cathode of the light-emitting diode 25. The anode of the light-emitting diode 25 is connected to the cathode of the diode 27, and the anode of the diode 27 is fastened to an elongated resilient conductor or electrical contact 33. The conductor 33 engages the collector ring 20 with an inward pressure sufficient to ensure good electrical communication therebetween. It is noted that with this structure, the primary source of illumination 12 may be removed from the flashlight 10 to afford replacement of the batteries 16, 16 and/or lamp 19 since the conductor 33 provides a releasable connection between the collector ring 20 and the secondary circuit in which the light-emitting diode 27 is connected. The collector ring 20 releasably engages the contact 33 upon movement of the ring 20 axially relative to the contact 33 such as when the reflector assembly 18 is screwed axially onto the casing 11. Thus, by unscrewing the reflector assembly 18 slightly, the collector ring 20 may be disengaged from the contact 33 to interrupt power to the light-emitting diode 25 to conserve the batteries, for instance, when the flashlight 10 is to be placed in storage for a length of time.

In operation, positive voltage is applied to the light-emitting diode 25 as long as the voltage of the batteries 16, 16 is above the aforementioned predetermined level. As a result, the light-emitting diode 25 emits a sufficient amount of light to enable the flashlight to be located even in the dark. Since the light-emitting diode 25 is connected in series with the bulb 19 and compression spring 17, failure of the light-emitting diode 25 to emit light would indicate either a burned-out bulb, dead batteries, an open circuit, or batteries having a minimal charge.

In the illustrated embodiment, a current-limiting resistor 26 is connected in series with the light-emitting diode 25 to limit the current flow therethrough to a relatively small value. It should be understood, however, that within the spirit and scope of the present invention, such resistance may be embodied in the light-emitting diode itself. Moreover, it is noted that in the event that battery voltage-level indication is not desired, the diode 27 may be eliminated. Of course, as one skilled in the art would readily appreciate, the diode 27 may be replaced by a zener diode of an appropriate value if cost is not an important factor in producting the flashlight 10.

Another embodiment of the present invention is illustrated in FIGS. 3–6. In this embodiment, a switch assembly having an off position and two on positions affording selective energization of either the primary light source or the secondary light source is provided. To this end, the modified flashlight 110, which is generally similar to the flashlight 10, has a switch assembly 113 comprising an operator 113*a* mounted for sliding movement on the outside of the casing 111 axially thereof. The operator 113*a* has three operating positions: the position illustrated in FIG. 3 in full lines being a first position interrupting power both to the primary light source 112 and to the secondary light source 125, the position illustrated in broken lines being a second position energizing the primary light source 112, and a third position intermediate the first and second positions energizing only the secondary light source 125. Thus, as the switch operator 113*a* is displaced leftward from the full line or off position indicated in FIG. 3, the secondary light source is illuminated first and the primary light source is illuminated second.

Figure 4:
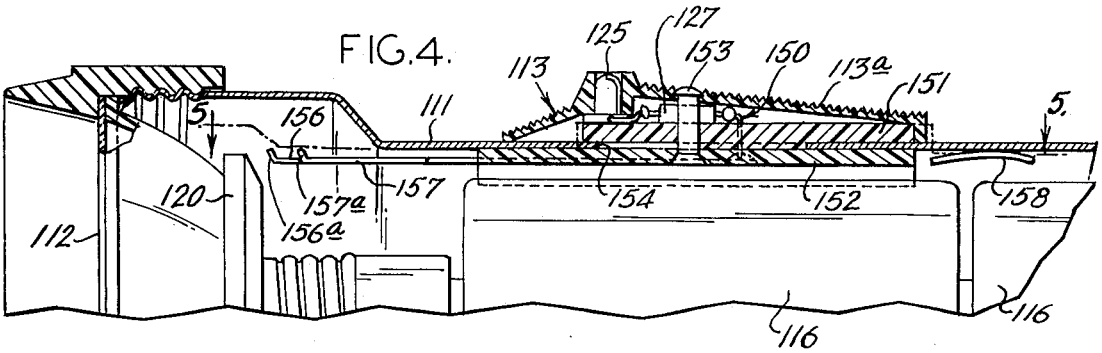
FIG. 4 is an enlarged fragmentary sectional view taken along line 4—4 of FIG. 3.

As best seen in FIG. 4, the switch assembly 113 mounts the secondary light source, or light-emitting diode 125, for movement therewith, and circuit means 150 for connecting the light-emitting diode 125 to the batteries 116, 116, is associated with the switch operator 113*a* and mounted for movement therewith relative to the casing 111. In the illustrated embodiment, the switch operator 113*a* is hollow, and the circuit means 150 is mounted on an outer support 151 which slides relative to the outside of the casing 11. An inner support 152 is mounted inside the casing for sliding movement, and the supports 151 and 152 are connected together by means of a fastener such as the rivet 153 which extends outwardly through an elongated slot 154 in the casing 111. The length of the slot 154 is preferably selected to cooperate with the rivet 153 to limit leftward sliding movement of the switch operator 113*a*, while a portion of the outer support extending into the slot 154 cooperates therewith to limit rightward movement of the switch operator 113*a*, as illustrated in FIG. 4.

Figure 5:
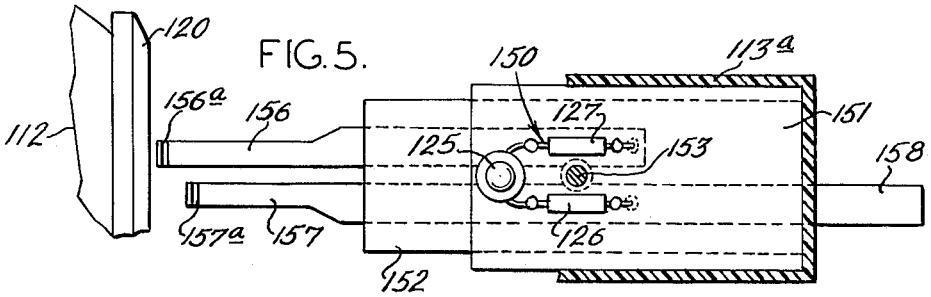
FIG. 5 is a fragmentary sectional view taken along line 5—5 of FIG. 4.
Figure 6:
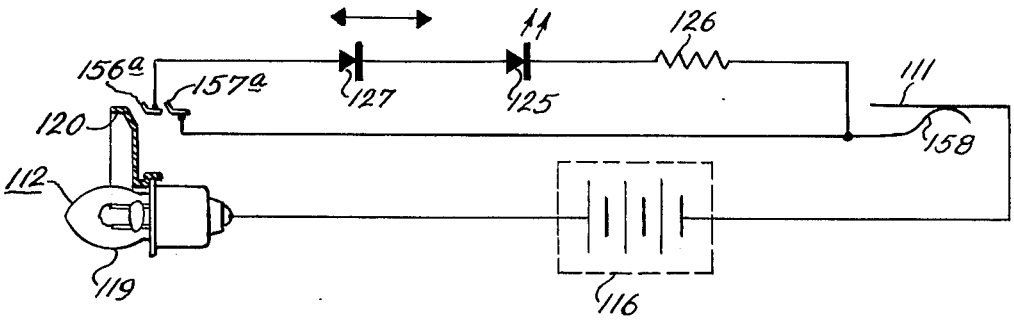
FIG. 6 is a schematic circuit diagram of the embodiment of FIGS. 3–5.

The primary source of illumination 112, like the primary source 12 in the embodiment of FIGS. 1 and 2, has a collector ring 120 which is electrically connected to a lamp 119 (FIG. 6). In this embodiment, the circuit means 150 includes a pair of contacts 156 and 157 both of which are mounted to the inner support 152 for movement with the switch operator 113*a*. A slide contact 158, in the present instance integral with the contact 157, continually engages and slides along the inside of the casing 111 which, like the casing 11, is metallic. The contacts 156 and 157 are preferably provided by resilient metal conductors which are elongated in the direction of movement of the switch operator 113*a* and which extend alongside one another in spaced relation. The contacts 156 and 157 terminate in tips 156*a* and 157*a*, respectively, the tip 157*a* being located further from the collector ring 120 than the tip 156*a*. As seen in FIGS. 4 and 5, the collector ring 120 is spaced from the inside of the casing 111 and is located in the path of movement of the contacts 156 and 157 so as to be engaged thereby when they are displaced axially relative to the collector ring 120.

As in the first-mentioned embodiment, the circuit means includes a diode 127 and a current-limiting resistor 126 connected to the light emitting diode 125 as indicated schematically in FIG. 6. The diode 127 is electrically connected to the rear or right end of the conductor 156, and the resistor 126 is connected to the other conductor 157. Thus, the circuit means 150 connects the light-emitting diode 125 across the conductors 156 and 157.

Figure 3:
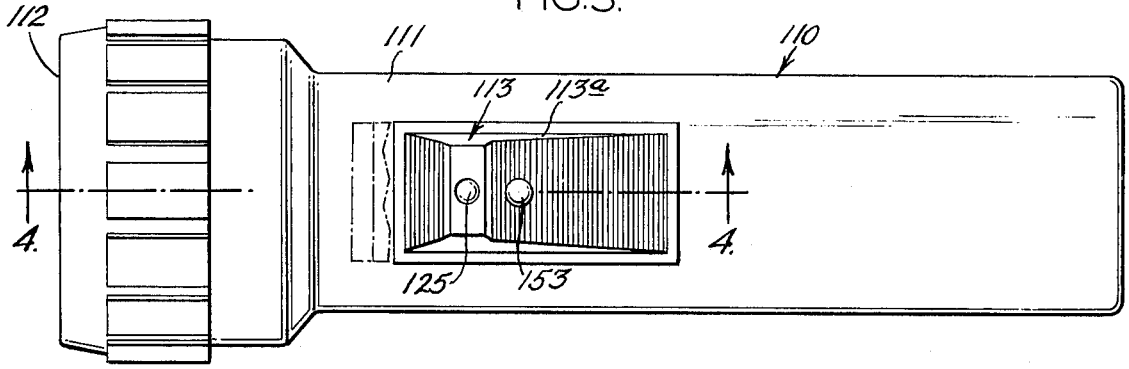
FIG. 3 is a top plan view of a modified embodiment of the present invention.

In operation, both the lamp 119 of the primary light source, and the light emitting diode of the secondary light source, are deenergized when the switch operator 113*a* is in the full line position in FIG. 3. When in this position, the contacts 156*a* and 157*a* are both spaced from the collector ring 120. To energize the light-emitting diode, the operator 113*a* is slid leftward a distance sufficient to cause the tip 156*a* of the conductor 156 to contact the collector ring 120 while the tip 157*a* of the conductor 157 is still spaced from the collector ring 120. This causes a positive voltage to be applied to the anode of the diode 127 and a negative voltage to be applied to the resistor 126 through the slide contact 158. As a result, current flows through the light-emitting diode 125 to cause the same to emit a beam of light. The lamp 119 does not light because the current flowing therethrough is too small due to the resistance in the resistor 126.

Displacement of the switch operator 113*a* further leftward into the broken line position indicated in FIG. 3 causes the tip 157*a* of the other conductor 157 to engage the collector ring 120. This connects the collector ring 120, and hence the lamp 119, directly to the negative battery terminal and causes the lamp 119 to light. At the same time, the light-emitting diode is automatically deenergized because of the shunting thereof by the low impedance connection afforded by the conductors 157 and 158.

Thus, this embodiment provides switch means to enable the secondary light source to be switched on and off as desired to conserve battery life. Furthermore, the switch is of sufficiently simple construction as to be capable of being manufactured economically on a production basis.

In view of the foregoing, it should be apparent that the present invention provides novel electric lanterns which have secondary sources of illumination provided by light-emitting diodes to afford locating the lanterns readily in the dark.

While preferred embodiments of the present invention have been described in detail, various modifications, alterations and changes may be made without departing from the spirit and scope of the present invention as defined in the appended claims.

I claim:

1. In a lantern including a casing adapted to contain an electrical power supply for providing a voltage output of at least a predetermined level, lamp means providing a primary source of illumination for projecting a beam of light of one intensity level, said primary illumination source means having an electrical collector ring spaced from the inside of the casing, means removably mounting said lamp means and collector ring in said casing, and a switch for connecting said collector ring and lamp means to said power supply, the improvement comprising: a light-emitting diode providing a secondary source of illumination carried by said casing, and circuit means contained by said casing for connecting said power supply to said light-emitting diode to cause said light-emitting diode to emit light of an intensity level substantially lower than the intensity level of said primary illumination source when said voltage is above said predetermined level, said circuit means including an electrical contact releasably engaging said collector ring upon movement of said collector ring inwardly of said casing toward said contact, whereby said light-emitting diode can be energized to emit light to facilitate location of the lantern in the dark when the primary source of illumination is off and said light-emitting diode can be de-energized upon outward movement of said collector ring.

2. A lantern according to claim 1 including a base in said casing adjacent said collector ring mounting said light emitting diode and said electrical contact, said other electrical contact including a resilient electrical conductor extending from said base and into said releasable engagement with said collector ring.

3. A lantern according to claim 2 wherein said circuit means connecting said light emitting diode to said power supply includes a voltage-responsive diode and a resistor mounted on said base and connected in series with said light emitting diode, said voltage-responsive diode having an anode connected to said resilient conductor and a cathode connected to said light emitting diode.

4. In a lantern having a casing adapted to contain an electrical power supply and having a primary source of illumination carried by said casing for projecting a beam of light of one intensity level, the improvement comprising: a secondary source of illumination carried by said casing for emitting light of an intensity level substantially lower than the intensity level of the beam projected by said primary source of illumination; and, a slide switch carried by said casing for selectively connecting said sources of illuminatin to said power supply; said switch having a first position for interrupting power to said primary and secondary sources of illumination, a second position for supplying power to said primary source of illumination, and a third position intermediate said first and second positions for supplying power only to said secondary source of illumination, said slide switch including an operator on the outside of said casing and said secondary light source including a light emitting diode carried by said operator for movement therewith, whereby the switch operator is illuminated and the secondary source of illumination may be energized and de-energized as desired.

5. A lantern according to claim 4 wherein said switch includes a pair of electrical contacts mounted in said casing for movement with said switch operator and circuit means contained in said switch operator and connecting said light emitting diode across said contacts to cause said light-emitting diode to be de-energized automatically when said switch is placed in said second position to energize said primary illumination source.

6. A lantern according to claim 5 including stationary collector means connected in series with said primary illumination source and engageable with said switch contacts, one of said contacts adapted to engage said collector ahead of the other upon movement of said switch operator, said circuit means connecting said light emitting diode to said one contact providing a higher impedance to current flow from the power supply than provided through said other contact, so that engagement of said other contact with said collector means causes current to be shunted around said circuit means to de-energize said light-emitting diode.

7. A lantern according to claim 6 wherein said casing is electrically-conductive, said collector means is electrically connected intermediate said power supply and said switch contacts, and said switch includes a slide contact engaging the inside of the casing and connected in series with said light emitting diode circuit means and said other switch contact.

8. A lantern according to claim 7 wherein said circuit means includes a diode having its anode connected to said one switch contact and a high-impedance resistor connected to said slide contact with said light emitting diode connected in series therebetween.

9. In a lantern having a casing adapted to contain an electrical power supply and to mount lamp means having a collector connected thereto for causing a primary beam of light to be projected when said lamp means is energized by said power supply, the improvement comprising: means carried by said casing for emitting a secondary light beam of an intensity level substantially lower than the intensity level of said primary beam, a switch assembly for effecting selective emission of light from said lamp means and said secondary light beam emitting means, said switch assembly including an operator moveable in opposite directions on the outside of said casing, a pair of contacts mounted for movement in unison with said operator into and out of contact with said collector, circuit means connecting one of said contacts in one circuit branch to said secondary light beam emitting means and to said power supply when engaged with said collector and connecting the other of said contacts in another circuit branch to said power supply when engaged with said collector, said one contact being located closer to said collector than the other for engaging the collector to energize said secondary light emitting means before the other contact engages the collector to energize said lamp means upon movement of said switch operator in one of said directions.

10. A lantern according to claim 9 wherein said collector includes a ring connected in series with said lamp means to said power supply and said contacts include a pair of elongated resilient electrically-conductive strips extending in the direction of movement of said switch operator, said strips adapted to slidably engage the periphery of said ring upon movement of said operator in said one direction.

11. A lantern according to claim 10 wherein said switch assembly includes an inner support member mounting said conductive strips in spaced parallel relation in said casing, an outer support member mounting said secondary light beam emitting means outside of said casing, and means connecting said support members together for movement relative to said casing.

12. A lantern according to claim 9 wherein said secondary light beam emitting means includes a light emitting diode, and said one circuit branch has one impedance level and said other circuit branch has another impedance level, said one impedance level being of a magnitude substantially greater than said other impedance level, so that when said one contact is engaged with said collector means, said lamp means and light emitting diode are connected in series and current of a magnitude sufficient to illuminate said light emitting diode but insufficient to illuminate said lamp flows through said one circuit branch.

13. A lantern according to claim 12 wherein said one circuit branch includes voltage responsive means connected therein to prevent current from flowing through said one circuit branch when the power supply voltage is below a predetermined level.

* * * * *